US007946867B2

(12) United States Patent
Zhou et al.

(10) Patent No.: US 7,946,867 B2
(45) Date of Patent: May 24, 2011

(54) CARD CONNECTOR WITH A SPRING MEMBER FOR RETAINING AN ELECTRICAL CARD

(75) Inventors: Feng Zhou, Kunshan (CN); Qi-Jun Zhao, Kunshan (CN)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 0 days.

(21) Appl. No.: 12/763,147

(22) Filed: Apr. 19, 2010

(65) Prior Publication Data

US 2010/0267267 A1 Oct. 21, 2010

(30) Foreign Application Priority Data

Apr. 17, 2009 (CN) ..... 2009 2 0302294

(51) Int. Cl.
*H01R 13/62* (2006.01)

(52) U.S. Cl. ..... 439/159

(58) Field of Classification Search ..... 439/327–328, 439/159–160

See application file for complete search history.

(56) References Cited

U.S. PATENT DOCUMENTS

| | | | | |
|---|---|---|---|---|
| 6,394,827 | B2 * | 5/2002 | Nogami | 439/159 |
| 6,398,567 | B1 * | 6/2002 | Nishimura | 439/159 |
| 6,776,632 | B2 | 8/2004 | Kikuchi et al. | |
| 6,929,490 | B2 * | 8/2005 | Kodera et al. | 439/159 |
| 6,981,885 | B2 * | 1/2006 | Oh | 439/159 |
| 7,033,190 | B1 * | 4/2006 | Chen | 439/159 |
| 7,070,429 | B2 * | 7/2006 | Kodera et al. | 439/159 |
| 7,182,613 | B2 * | 2/2007 | Xu et al. | 439/159 |
| 7,416,427 | B2 * | 8/2008 | Ting | 439/159 |

* cited by examiner

*Primary Examiner* — Jean F Duverne
(74) *Attorney, Agent, or Firm* — Wei Te Chung; Andrew C. Cheng; Ming Chieh Chang

(57) ABSTRACT

A card connector includes an insulative housing (1) having a receiving space (10); a set of contacts (2) retained in the insulative housing and protruding into the receiving space for electrical connection to the electrical card; a metal spring member (3) having an arcuate locking arm (34) protruding toward the receiving space for retaining the electrical card in the receiving space; and a metal guiding member (4) having a guiding portion (41) extending along the front-to-back direction for guiding a lateral side of the electrical card and a resisting portion (44) extending from a back end of the guiding portion for resisting a front free end portion (34) of the locking arm outwardly.

11 Claims, 4 Drawing Sheets

CARD CONNECTOR WITH A SPRING MEMBER FOR RETAINING AN ELECTRICAL CARD

BACKGROUND OF THE INVENTION

1. Field of the Invention

The present invention relates to a card connector, and more particularly to a card connector having a spring member for retaining an electrical card.

2. Description of Related Art

With constant development of communications and computer technology, more and more electrical cards are being designed to meet various requirements. Electrical card connectors are used to connect these electrical cards with corresponding mainframes. A conventional card connector usually comprises an insulative housing, a plurality of terminals coupled thereto, a spring member for retaining the electrical card, and a shell shielding the insulative housing. The spring member is usually retained in the insulative housing. Some card connectors further comprise ejecting mechanisms retained in the insulative housing to form push-push type card connectors. In these push-push type card connectors, the spring member is usually retained in a slider which is movable with the electrical card in the ejecting mechanism. The spring member has a cantilever locking arm for resisting or locking with the electrical card so as to retain the electrical card in the receiving space.

When the electrical card is inserted into the receiving space, especially when the electrical card is slantwise inserted into the receiving space at the beginning, the electrical card will conflict with a front free end of the locking arm and can not be inserted into the receiving space effectively.

Hence, an improved card connector is desired to overcome the above problems.

BRIEF SUMMARY OF THE INVENTION

According to one aspect of the present invention, a card connector for insertion of an electrical card comprises an insulative housing defining a receiving space for insertion of the electrical card along a front-to-back direction; a plurality of contacts retained in the insulative housing and protruding into the receiving space for electrical connection to the electrical card; a metal spring member having an arcuate locking arm protruding toward the receiving space for retaining the electrical card in the receiving space; and a metal guiding member having a guiding portion extending along the front-to-back direction for guiding a lateral side of the electrical card and a resisting portion extending from a back end of the guiding portion for resisting a front free end portion of the locking arm outwardly.

According to another aspect of the present invention, a card connector for insertion of an electrical card comprises an insulative housing comprising a receiving space for insertion of the electrical card along a front-to-back direction, a bottom wall being located under the receiving space, a rear wall extending upwardly from a rear end of the bottom wall, and a first side wall extending upwardly from a lateral side of the bottom wall and connecting with the rear wall, the first side wall defining a cavity formed therein and communicating with the receiving space; a plurality of contacts retained in the insulative housing and protruding into the receiving space for electrical connection to the electrical card; a metal spring member having an arcuate locking arm being movably received in the cavity along a transverse direction and protruding toward the receiving space for locking with a notch of the electrical card; and a metal guiding member having a securing portion retained in the first side wall, a guiding portion extending along an inner face of the first side wall for guiding a lateral side of the electrical card, and a resisting portion extending from a back end of the guiding portion for resisting a front free end portion of the locking arm to prevent the free end portion from inwardly over deformation.

The foregoing has outlined rather broadly the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE PREFERRED EMBODIMENT

Figure 1:
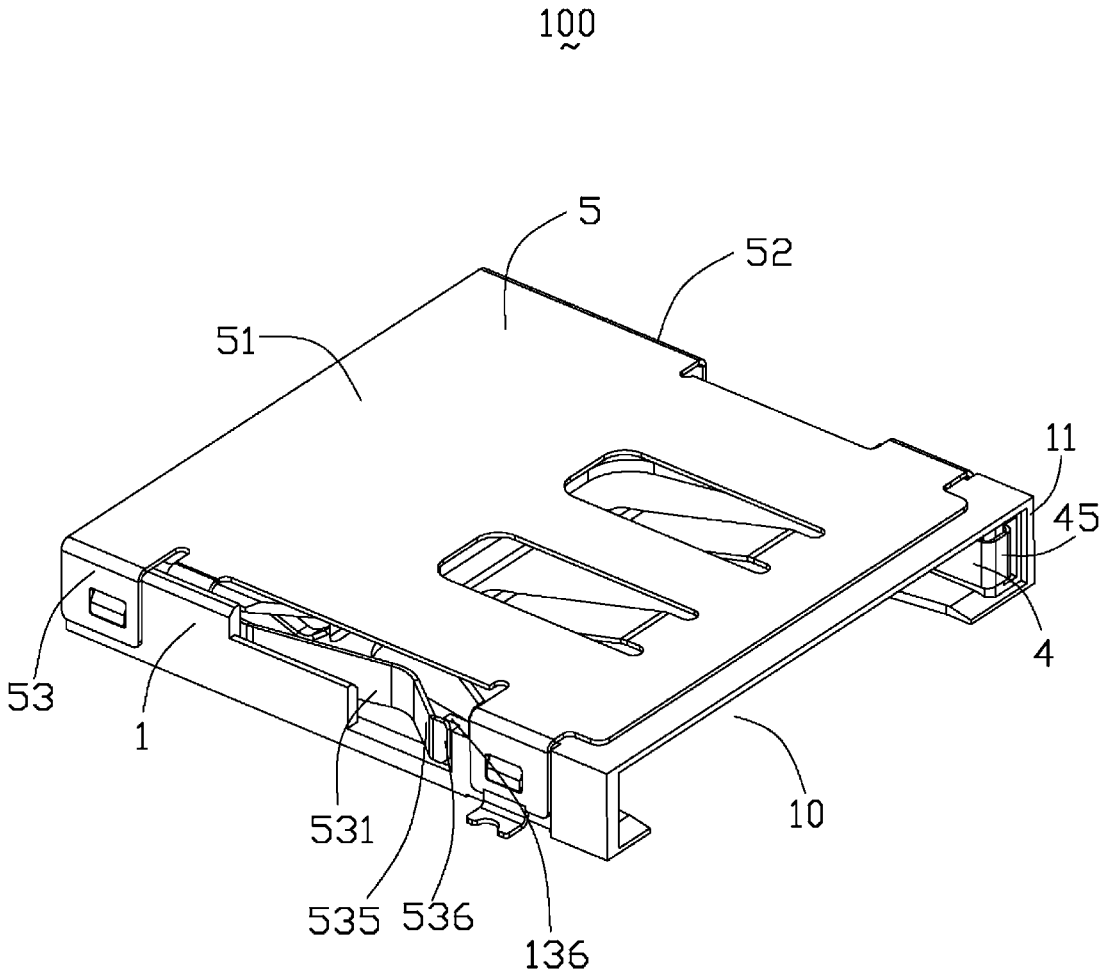
FIG. 1 is a perspective view of a card connector according to the present invention.

In the following description, numerous specific details are set forth to provide a thorough understanding of the present invention. However, it will be obvious to those skilled in the art that the present invention may be practiced without such specific details. In other instances, well-known circuits have been shown in block diagram form in order not to obscure the present invention in unnecessary detail. For the most part, details concerning timing considerations and the like have been omitted inasmuch as such details are not necessary to obtain a complete understanding of the present invention and are within the skills of persons of ordinary skill in the relevant art.

Referring to FIGS. 1-4, a card connector 100 for insertion of an electrical card (not shown) according to the present invention, comprises an insulative housing 1, a plurality of terminals 2 retained in the insulative housing 1, a metal spring member 3 and a guiding member 4 coupled to the insulative housing 1, and a shell 5 covering the insulative housing 1. In the preferred embodiment, the memory card connector 100 is a Memory Stick (MS) card connector for receiving a corresponding Memory Stick (MS) card.

Figure 2:
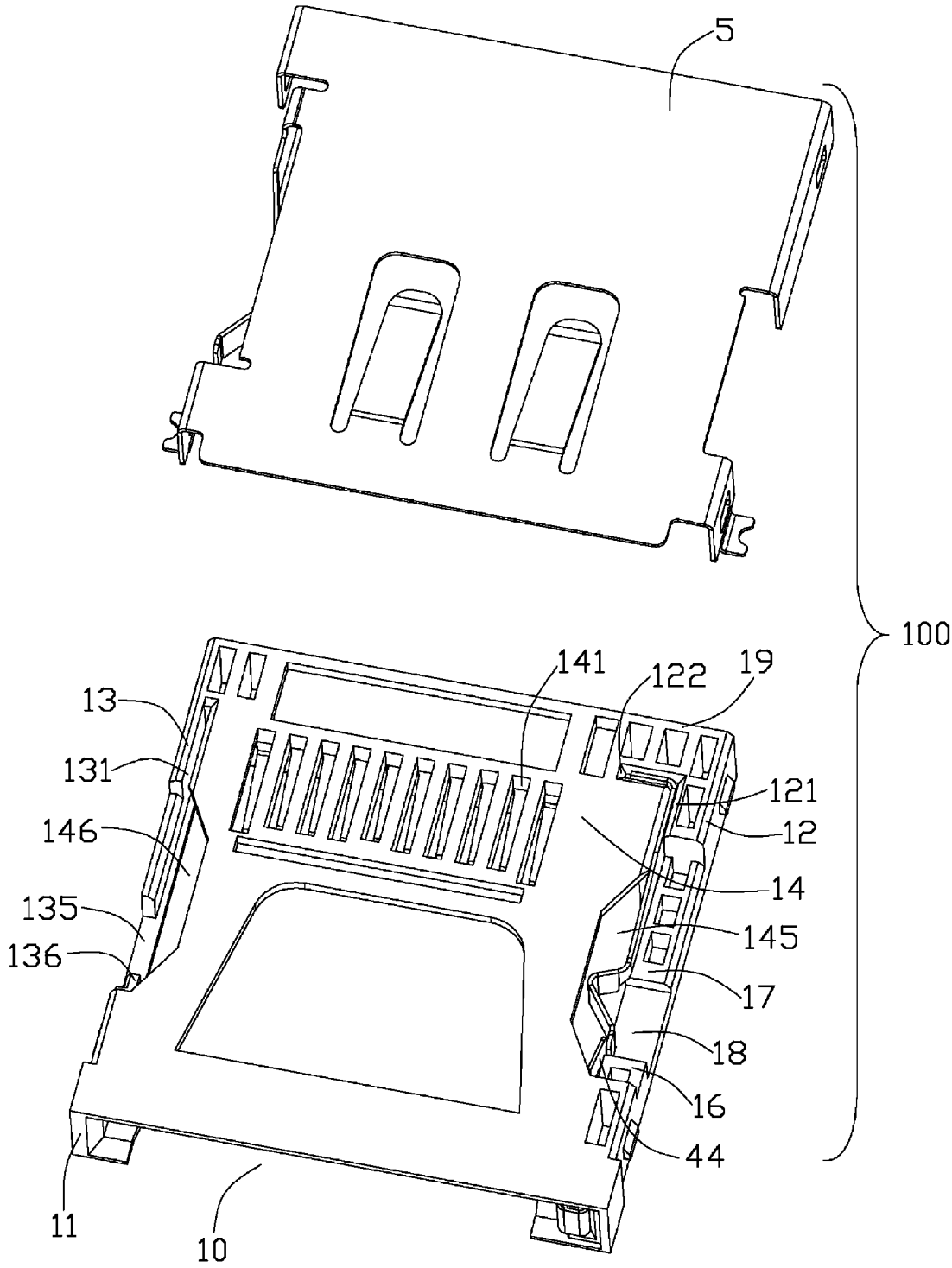
FIG. 2 is a partly exploded view of the card connector shown in FIG. 1.
Figure 3:
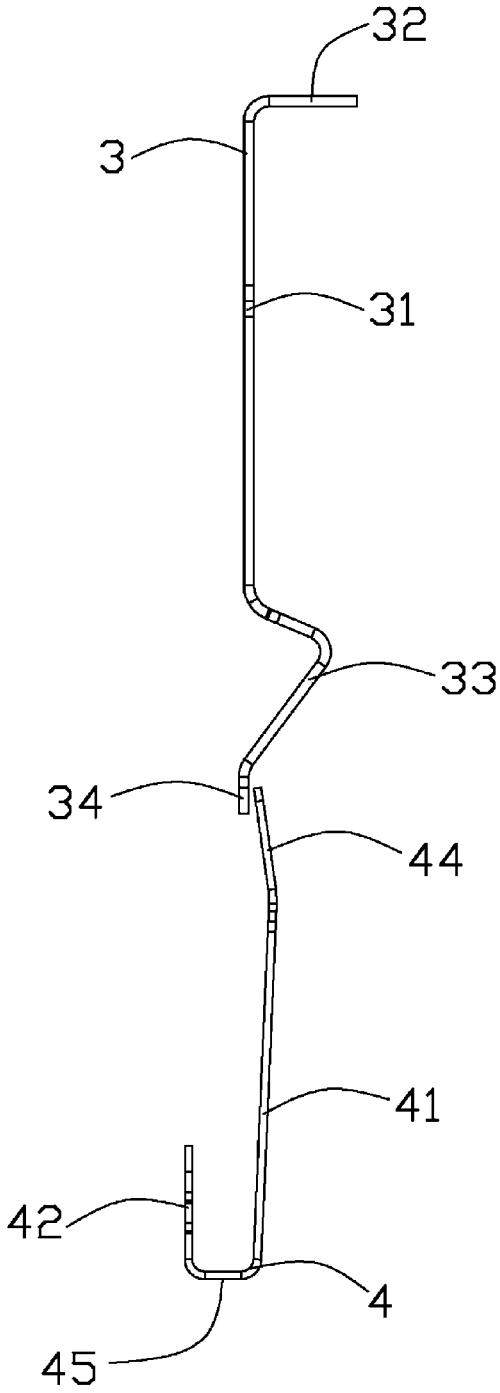
FIG. 3 is a perspective view of a spring member and a guiding member of the card connector shown in FIG. 1.
Figure 4:
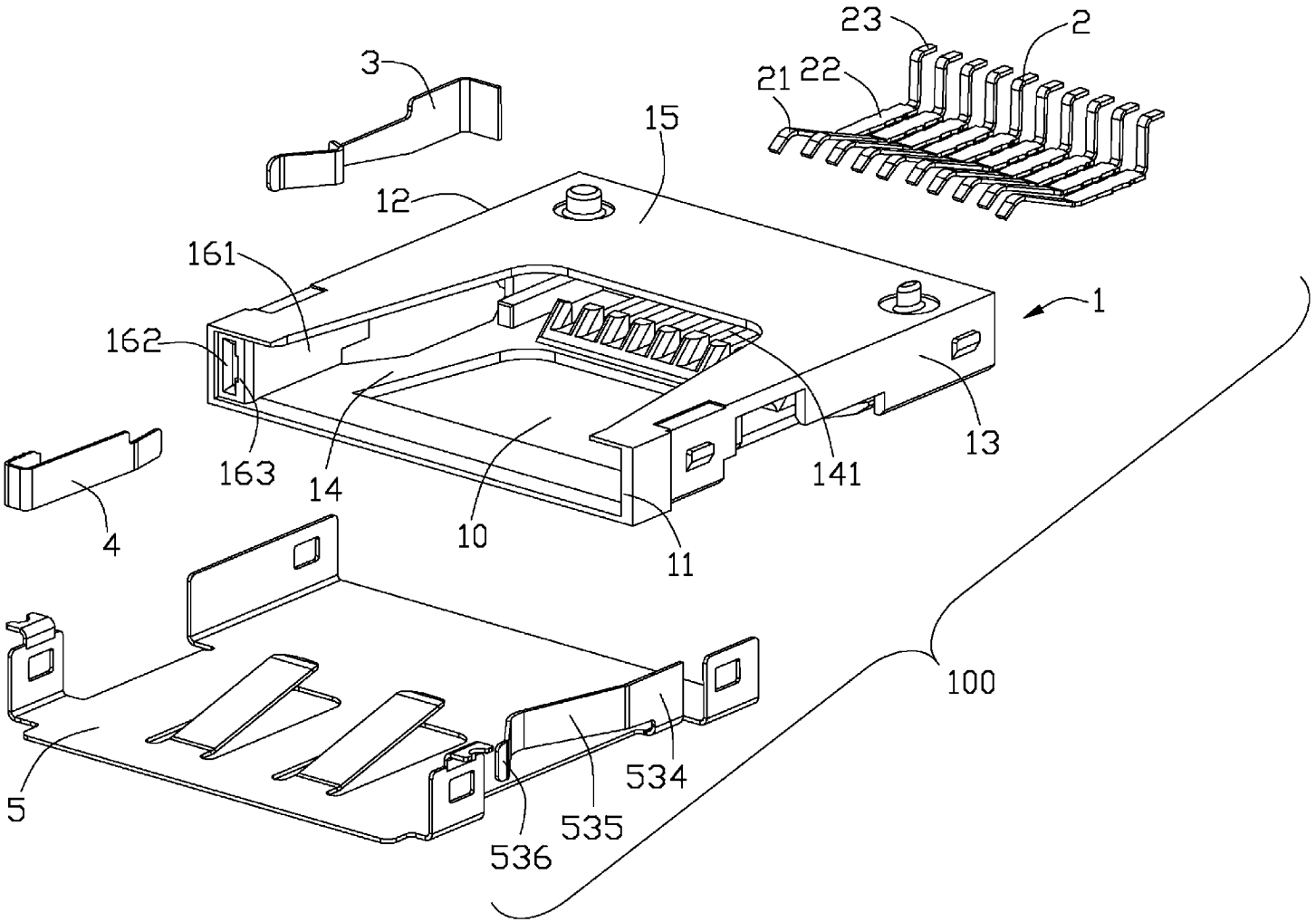
FIG. 4 is an exploded view of the card connector shown in FIG. 1.

Referring to FIGS. 2-4, the insulative housing 1 defines a receiving space 10 recessed backwardly from a front mating face 11 thereof for insertion of the electrical card. The insulative housing 1 comprises a bottom wall 15, a rear wall 19 extending upwardly from a rear end of the bottom wall 15, a pair of right and left side walls 12, 13, extending upwardly from two lateral sides of the bottom wall 15 and connecting with the rear wall 19, and a top wall 14 opposed to the bottom wall 15. The receiving space 10 is surrounded by the top wall 14, the bottom wall 15, the rear wall 19, and the right and left side walls 12, 13. The top wall 14 has a plurality of passageways 141 for receiving the terminals 2 so as to form a reverse type card connector 100 for receiving the electrical card. The right side wall 12 has a cavity 18 passing therethrough along a transverse direction and communicating with the receiving space 10. The right side wall 12 is separated by the cavity 18 into a front first portion 16 and a rear second portion 17. A groove 162 is recessed backwardly from a front face 163 of the first portion 16 for retaining the guiding member 4.

Each terminal 2 has a connecting portion 22 retained in the rear wall 19, a contacting portion 21 extending forwardly from the connecting portion 22, and a tail portion 23 extending downwardly and bending backwardly from a rear end of the connecting portion 22 for electrical connection to a printed circuit board (not shown). The contacting portions 21 are received in the passageways 141 and protrude downwardly into the receiving space 10 for electrical connection to the electrical card.

Referring to FIGS. 1-4, the spring member 3 has a L-shaped retaining portion retained into a L-shaped retaining slot formed on the insulative housing 1, an arcuate locking arm 33 extending forwardly from the L-shaped retaining portion and protruding inwardly into the receiving space 10 for locking with a notch of the electrical card. A free end portion 34 is formed at front of the locking arm 33 and movably received in the cavity 18. The L-shaped retaining portion includes a first part 32 extending along the transverse direction and retained in a first slot 122 formed between the top wall 14 and the rear wall 19, and a second part 31 extending along a front-to-back direction perpendicular to the transverse direction and retained in a second slot 121 formed between the top wall 14 and the second portion 17 of the right side wall 12. The first slot 122 and the second slot 121 formed the L-shaped retaining slot. The top wall 14 has a first opening 145 formed at a right side thereof and communicating with the second slot 121 for accommodating the locking arm 33 to be assembled in the insulative housing 1 conveniently.

The guiding member 4 has a securing portion 42 retained in the groove 162 of the first portion 16, a bending portion 45 bending inwardly from a front end of the securing portion, a guiding portion 41 extending backwardly from the bending portion 45 and extending along an inner side 161 of the first portion 16, and a slanted resisting portion 44 extending backwardly from a rear end of the guiding portion 41 and slanting outwardly for resisting the free end portion 34 of the spring member 3 outwardly. The bending portion abuts backwardly against the front face 163 of the first portion 16 and is coplanar with the front mating face 11. When the electrical card is inserted into the receiving space 10 at the beginning, the guiding member 4 can guide a right side of the electrical card sliding forwardly and make the electrical card insert into the receiving space smoothly, a front side of the electrical card will not conflict with the front free end portion 34 of the locking arm 33 which is resisted by the resisting portion 44, and the locking arm 33 is deflected outwardly in the cavity 18 by the right side of the electrical card. When the electrical card is inserted into the receiving space 10 completely, the locking arm 33 locks into the notch of the electrical card so as to retain the electrical card into the receiving space 12 firmly. In this embodiment, the guiding portion 41 of the guiding member 4 abuts against the inner face 161 of the first portion 16. In another embodiment, a clearance could be formed between the guiding portion 41 and the inner face 161 of the first portion 16, when the electrical card is inserted into the receiving space 10 at the beginning, the guiding portion 41 is deflected by the right side of the electrical card, the resisting portion 44 urges the free end portion 34 to drive the locking arm 33 moving outwardly from the receiving space 10 into the cavity 18, therefore, the electrical card will be inserted into the receiving space 10 more easily.

The shell 5 is stamped from one piece of metal sheet and comprises a top plate 51 covering the top wall 14, a pair of right and left side plates 52, 53 extending downwardly from two lateral sides of the top plate 51 and being retained in the right and left walls 12, 13. A spring tab 531 is integrally extending downwardly from the top plate 51. The spring tab 531 has a retaining tab 534 retained in a slit 131 formed between the top wall 14 and the left wall 13, and a clamping arm 535 extending forwardly from the retaining tab 534 for resisting a left side of the electrical card. The top wall 14 has a second opening 146 formed at a left side thereof and communicating with the slit 131 for accommodating the clamping arm 535 to be assembled in the insulative housing 1 conveniently. The left side wall 13 has a cutout 135 for movably accommodating the clamping arm 535 and a stopping portion 136 located at front of the cutout 135 for resisting a distal end 536 of the spring tab 531 outwardly so as to prevent the clamping arm 535 from inwardly over deformation.

It is to be understood, however, that even though numerous, characteristics and advantages of the present invention have been set fourth in the foregoing description, together with details of the structure and function of the invention, the disclosed is illustrative only, and changes may be made in detail, especially in matters of number, shape, size, and arrangement of parts within the principles of the invention to the full extent indicated by the broad general meaning of the terms in which the appended claims are expressed.

What is claimed is:

1. A card connector for insertion of an electrical card comprising:

an insulative housing defining a receiving space for insertion of the electrical card along a front-to-back direction;

a plurality of contacts retained in the insulative housing and protruding into the receiving space for electrical connection to the electrical card;

a metal spring member having an arcuate locking arm protruding toward the receiving space for retaining the electrical card in the receiving space; and a metal guiding member having a guiding portion extending primarily along the front-to-back direction for guiding a lateral side of the electrical card and a resisting portion extending from a back end of the guiding portion for resisting a front free end portion of the locking arm outwardly; wherein the insulative housing comprises a bottom wall located under the receiving space, a rear wall extending upwardly from a rear end of the bottom wall, and a first side wall extending upwardly from a lateral side of the bottom wall and connecting with the rear wall, the first side wall has a cavity passing therethrough along a transverse direction and communicating with the receiving space for accommodating the locking arm to be movable along the transverse direction, the first side wall is separated by the cavity into a front first portion and a back second portion; wherein the spring member has an L-shaped retaining portion retained into an L-shaped retaining slot formed on the insulative housing, the locking arm extends from a front end of the L-shaped retaining portion; wherein the insulative housing comprises a top wall opposed to the bottom wall and space apart from the top wall with the receiving space, the L-shaped retaining portion comprises a first portion extending along the transverse direction and retained in a first slot formed between the top wall and the rear wall, and a second portion extending along the front-to-back direction and retained in a second slot formed between the top wall and the second portion of the first side wall, the first slot and the second slot form as the L-shaped retaining slot; wherein the top wall has a first opening communicating with the second slot for accommodating the locking arm to be assembled into the insulative housing; wherein the insulative housing further comprises a second side wall opposite to the first side wall and extending upwardly from the other lateral side of the bottom wall, the card connector further comprises a metal shell shielding the insulative housing, the shell has a top plate covering the top wall and a spring tab bending downwardly from the top plate, the spring tab has a retaining tab retained in a slit formed between the top wall and the second side wall, and a clamping arm extending from the retaining tab for resisting the other lateral side of the electrical card; wherein the top wall has a second opening communicating with the slit for accommodating the clamping arm to be assembled into the insulative housing, the second side wall has a cutout passing therethrough along the transverse direction and communicating with the receiving space for movably accommodating the clamping arm, and a stopping portion located at front of the cutout for resisting a distal end of the spring tab outwardly so as to prevent the clamping arm from inwardly over deformation.

2. The card connector according to claim 1, wherein the first portion has a groove recessed backwardly from a front face thereof, the guiding member has a securing portion retained in the groove, the guiding portion bends backwardly from a front end of the securing portion and extending along the first portion, the resisting portion extends backwardly and slants outwardly from the guiding portion.

3. The card connector according to claim 2, wherein the guiding portion is spaced apart from the guiding portion and forms a clearance therebetween, when the electrical card is inserted into the receiving space, the guiding portion is deflected by the electrical card, and the resisting portion urges the free end portion to drive the locking arm moving outwardly in the cavity.

4. A card connector for insertion of an electrical card comprising:

an insulative housing comprising a receiving space recessed backwardly from a front mating face thereof for insertion of the electrical card along a front-to-back direction, a bottom wall being located under the receiving space, a rear wall extending upwardly from a rear end of the bottom wall, and a first side wall extending upwardly from a lateral side of the bottom wall and connecting with the rear wall, the first side wall defining a cavity formed therein and communicating with the receiving space;

a plurality of contacts retained in the insulative housing and protruding into the receiving space for electrical connection to the electrical card;

a metal spring member having an arcuate locking arm being movably received in the cavity along a transverse direction and protruding toward the receiving space for locking with a notch of the electrical card; and a metal guiding member having a securing portion retained in the first side wall, a guiding portion extending along an inner face of the first side wall for guiding a lateral side of the electrical card, and a resisting portion extending from a back end of the guiding portion for resisting a front free end portion of the locking arm to prevent the free end portion from inwardly over deformation ; wherein the first side wall is separated by the cavity into a front first portion and a back second portion, the first portion has a groove recessed backwardly from a front face thereof for retaining the securing portion, the guiding member has a bending portion bending inwardly from a front end of the securing portion and connecting with the guiding portion, the bending portion abuts backwardly against the front face of the first portion and is coplanar with the front mating face, the resisting portion extends backwardly and slants outwardly from the guiding portion; wherein the guiding portion is spaced apart from the inner face of the guiding portion and forms a clearance therebetween, when the electrical card is inserted into the receiving space, the guiding portion is deflected by the lateral side of the electrical card, and the resisting portion urges the free end portion to drive the locking arm moving outwardly from the receiving space into the cavity; wherein the insulative housing comprises a top wall opposed to the bottom wall and space apart from the top wall with the receiving space, the spring member has a L-shaped retaining portion comprising a first portion extending along the transverse direction and sandwiched between the top wall and the rear wall, and a second portion extending along the front-to-back direction and sandwiched between the top wall and the first side wall, the locking arm extends from a front end of the second portion.

5. The card connector according to claim 4, wherein the top wall has a first opening for accommodating the locking arm to be assembled into the insulative housing.

6. The card connector according to claim 5, wherein the insulative housing further comprises a second side wall opposite to the first side wall and extending upwardly from the other lateral side of the bottom wall, the card connector further comprises a metal shell shielding the insulative housing, the shell has a top plate covering the top wall and a spring tab bending downwardly from the top plate, the spring tab has a retaining tab sandwiched between the top wall and the second side wall, and a clamping arm extending from the retaining tab for resisting the other lateral side of the electrical card.

7. An electrical card connector for use with an electrical card, comprising:

an insulative housing defining a card receiving space extending in a front-to-back direction with opposite first and second lateral sides thereof;

a plurality of contacts disposed in the housing with contacting sections extending into the card receiving space;

a metallic shell assembled to the housing and covering the card receiving space in a vertical direction;

a metallic spring member located at said first side and defining an angled locking arm extending inwardly and laterally into the card receiving space for engagement within a side notch of said electrical card; and a metallic resilient guiding member located at said first side and defining a guiding portion extending along an slightly oblique direction relative to the front-to-back direction for lateral engagement with a corresponding lateral side of the electrical card received in said card receiving space; wherein the guiding member is essentially located in front of the spring member, and the spring member extends forwardly and the guiding member extends rearwardly toward said spring member under condition that the spring arm defines an abutment section constantly inwardly confronting a corresponding engagement section formed on the guiding member and thus constantly located on an outward lateral position with regard to said corresponding engagement section so as to not only obtain a maximum laterally inward preloaded force of said locking arm when no electrical card is inserted into the card receiving space while automatically forcing said locking arm to laterally outwardly deflected by said guiding portion during initial insertion of the electrical card into the care receiving space before the inserted card touches the locking arm and pushed the locking arm to be laterally outwardly deflected.

8. The electrical card connector as claimed in claim 7, wherein said abutment section is located at a foremost distal end of the locking arm, and the engagement section is located at a rearmost distal end of the guiding portion.

9. The electrical card connector as claimed in claim 7, wherein the metallic shell defines a resilient clamping arm on the second side of the card receiving space constantly laterally inwardly engaged with another corresponding lateral side of the electrical card.

10. The electrical card connector as claimed in claim 9, wherein said clamping arm extends forwardly, and the housing defines a cutout in a corresponding lateral arm to allow said clamping arm to laterally inwardly extend into said card receiving space.

11. The electrical card connector as claimed in claim 10, wherein said lateral arm of the housing defines a stopping portion against which a free end of said clamping arm abuts.

* * * * *